US007527445B2

(12) United States Patent
Kanari et al.

(10) Patent No.: US 7,527,445 B2
(45) Date of Patent: May 5, 2009

(54) WRITING INSTRUMENT

(75) Inventors: Hiroyuki Kanari, Aizuhongo-machi (JP); Yousuke Ishii, Koriyama (JP)

(73) Assignee: Micro Co., Ltd. (JP)

( * ) Notice: Subject to any disclaimer, the term of this patent is extended or adjusted under 35 U.S.C. 154(b) by 513 days.

(21) Appl. No.: 11/136,962

(22) Filed: May 25, 2005

(65) Prior Publication Data

US 2005/0276652 A1 Dec. 15, 2005

(30) Foreign Application Priority Data

Jun. 4, 2004 (JP) ..... 2004-167107

(51) Int. Cl.
*B43K 5/16* (2006.01)

(52) U.S. Cl. ..... 401/112; 401/110

(58) Field of Classification Search ..... 401/112–114, 401/109–111

See application file for complete search history.

(56) References Cited

U.S. PATENT DOCUMENTS

| | | | | |
|---|---|---|---|---|
| 3,137,276 | A * | 6/1964 | Weisser | 401/111 |
| 3,273,541 | A * | 9/1966 | Thurman et al. | 401/111 |
| 5,004,364 | A | 4/1991 | Tomura et al. | 401/110 |
| 5,263,786 | A | 11/1993 | Kageyama | 401/111 |
| 5,413,428 | A | 5/1995 | Kageyama | 401/110 |

* cited by examiner

*Primary Examiner*—David J Walczak
(74) *Attorney, Agent, or Firm*—Adams & Wilks

(57) ABSTRACT

A writing instrument has a writing refill slidably disposed in a tubular casing. A rotary cam mechanism extends and retracts the writing refill in response to knocking of a knocking member at a rear end of the casing. The rotary cam mechanism includes a cam cylinder inserted axially into the rear end of the casing, and projections on the cam cylinder engage with apertures in the casing to prevent axial movement of the cam cylinder inside the casing. Rotational movement of the knocking member rotates the cam cylinder and disengages the projections from the apertures, thereby permitting withdrawal of the cam cylinder from the casing and replenishment of the writing refill.

29 Claims, 9 Drawing Sheets

WRITING INSTRUMENT

BACKGROUND OF THE INVENTION

1. Field of the Invention

The present invention relates generally to writing instruments and, more specifically, to a writing instrument, such as a ballpoint pen, having a rotary cam mechanism for feeding a writing refill of the writing instrument.

2. Background Information

Various types of conventional writing instruments having a structure in which a writing refill is fed by a knocking operation using a rotary cam mechanism have been known as described in U.S. Pat. Nos. 5,413,428, 5,263,786 and 5,004,364. The rotary cam mechanism has a stationary cam formed on an inner face of a barrel, a rotary cam abutting a rear end of a writing refill and engaged with the stationary cam, and a knocking cam inserted in the stationary cam and which moves the rotary cam in an axial direction. The rotary cam mechanism is constructed so that by knocking the knocking cam, the rotary cam is rotated and its engagement position with the stationary cam is changed, by which the writing refill is protruded to a writing position or retracted to an accommodated position within the barrel. More specifically, the stationary cam has a guide groove extending in the axial direction and a slant cam face. The rotary cam has a guide projection which enters the guide groove of the stationary cam and a rotary cam face which engages with the slant cam face of the stationary cam. The knocking cam has an engagement projection which enters the guide groove of the stationary cam and a knocking cam face which engages with the rotary cam face of the rotary cam. The writing refill is urged backward by a spring and its rear end abuts on the rotary cam. Accordingly, the rotary cam and the knocking cam are urged rearwardly by the spring.

When the knocking cam is knocked, the rotary cam advances, the guide projection comes out of the guide groove of the stationary cam, and the rotary cam rotates by the actions of the rotary cam face and the knocking cam face. By this construction and operation, the rotary cam face of the rotary cam engages with the slant cam face of the stationary cam, and the rotary cam is maintained at the advanced position. Since the writing refill is advanced by the rotary cam, the front end of the writing refill protrudes from the front end of the barrel and can be used for writing.

When the knocking cam is knocked again in the writing state, the rotary cam is pressed and advanced by the knocking cam, the slant cam face and the rotary cam face are disengaged, and the rotary cam is further rotated. Then, the guide projection of the rotary cam enters the guide groove of the stationary cam, whereby the rotary cam and the writing refill urged backward by the spring are retracted, and the front end of the writing refill is accommodated in the barrel.

Since the entire body of the rotary cam mechanism is pressed backward by the spring which urges the writing refill backward as described above, the stationary cam forming part of the rotary cam mechanism is integrally formed on an inner wall of the barrel as described in U.S. Pat. Nos. 5,004,364 and 5,263,786, or a cam body including the stationary cam is formed and the cam body is fixed under a detachment-preventing state on the inner face of the barrel as described in U.S. Pat. No. 5,413,428.

Accordingly, the conventional writing instruments require the rotary cam and the knocking cam to be inserted in the stationary cam which is fixed as described above, from the front portion of the stationary cam, whereby the conventional writing instruments having the rotary cam mechanism are constructed so that the front portion of the barrel can be opened. As the structure for opening the front portion of the barrel, a nose cone (tip) is detachably disposed at the front end of the barrel by screwing, or the barrel is constructed so as to be separable into upper and lower parts. Accordingly, when the writing refill is changed, in many cases, the barrel constructed of separable parts must be disassembled, or the nose cone screwed at the front end of the barrel must be detached to open the front end of the barrel. Since such a screwed part is necessarily provided, the nose cone portion becomes large in diameter to some extent, or when the barrel is transparent, the screwed part or the like is seen from the exterior thereof which presents an unsightly appearance. Accordingly, the conventional writing instruments are associated with restrictions in both design and aesthetic appearance.

SUMMARY OF INVENTION

It is an object of the present invention to provide a writing instrument having a rotary cam mechanism for feeding a writing refill, wherein the writing refill can be changed from the rear end side of a casing or barrel without detaching a nose cone or disassembling the barrel of the writing instrument.

It is another object of the present invention to provide a writing instrument in which a writing refill can be changed by rotating a knocking part of the rotary cam mechanism without deterioration of the external appearance of the writing instrument.

It is still a further object of the present invention to provide a writing instrument which has a simple construction and which may be made economically and used in a convenient manner.

The foregoing and other objects of the present invention are carried out by a writing instrument comprising a tubular casing having a longitudinal axis, a through-hole extending in a longitudinal direction of the longitudinal axis, a wall surface, and an aperture formed in the wall surface. A writing refill is inserted in the through-hole of the tubular casing for extension out of the casing to a writing position and retraction into the casing to a retracted position. A rotary cam mechanism is accommodated in the through-hole of the casing for extending and retracting the writing refill between the writing position and the retracted position, respectively. The rotary cam mechanism comprises a cam cylinder having a projection engaging the aperture of the casing and a stationary cam, a rotary cam engageable with the stationary cam of the cam cylinder, and a knocking cam engageable with the stationary cam of the cam cylinder and the rotary cam. A knocking member is integrally connected to the knocking cam and is connected to the cam cylinder in a non-rotatable state while permitting movement of the knocking member relative to the cam cylinder in the longitudinal direction.

The stationary cam has a guide groove and a slant cam surface. The rotary cam has a guide projection inserted in the guide groove of the stationary cam and a rotary cam surface engageable with the slant cam surface of the stationary cam. The knocking cam has a locking projection inserted in the guide groove of the stationary cam and a knocking cam surface engageable with the rotary cam surface of the rotary cam.

In another embodiment, the writing instrument has a stopper integrally connected to an inner surface of the casing. Instead of being formed in the wall surface of the casing, the aperture is formed in the stopper for engagement with the projection of the cam cylinder.

Preferably, in the foregoing embodiments of the writing instruments, the cam cylinder has a tubular construction, and the rotary cam and the knocking cam are inserted in the cam cylinder. The stationary cam is formed in an inner surface of the cam cylinder. The projection of the cam cylinder engages the aperture of the casing so that the cam cylinder is prevented from undergoing movement in the longitudinal direction relative to the casing while permitting rotational movement of the cam cylinder relative to the casing in a direction of rotation. The projection of the cam cylinder has a slant surface slanting towards the direction of rotation of the cam cylinder.

The writing instruments according to the present invention preferably further comprise means for permitting the projection of the cam cylinder to undergo elastic movement in a radial direction of the cam cylinder during rotation of the cam cylinder in the direction of rotation. In one embodiment, the means for permitting the projection of the cam cylinder to undergo elastic movement comprises an aperture formed in the cam cylinder adjacent to the projection. In another embodiment, the means for permitting the projection of the cam cylinder to undergo elastic movement comprises a pair of slits formed in the cam cylinder with the projection disposed between the slits.

Thus the writing instrument according to the present invention has an aperture formed in the casing or in a stopper integrally connected to the casing. The cam cylinder is inserted in the stopper or casing and is provided with the stationary cam, and the knocking element is connected to the cam cylinder so that it does not rotate but moves in the axial direction relative to the cam cylinder. By this construction, the projection disposed on the cam cylinder can be detachably engaged with the aperture of the casing or the stopper.

Thus, it is possible to easily assemble the foregoing components in the casing by firstly connecting the knocking element to the cam cylinder, accommodating the rotary cam and the knocking cam into the cam cylinder, and then inserting the cam cylinder from a rear end of the casing directly or doing so under the condition that the cam cylinder is inserted in the stopper. Thereafter, when the writing refill is changed by rotating the knocking element, the cam cylinder rotates and the projection of the cam cylinder disengages from the aperture of the casing or the stopper, whereby the cam cylinder can be separated from the stopper or casing, and the cam cylinder and the knocking element can be taken out of the rear portion of the casing. Accordingly, unlike with conventional writing instruments, the writing refill can be changed without opening a front portion of the casing.

After the writing refill is replaced with a new one, the cam cylinder is inserted in the stopper or casing. In this instance, if a guide edge is provided at the rear end of the stopper or on the inner face of the casing so as to guide the projection to the aperture of the casing or stopper, the projection can be engaged with the aperture without positioning and only by pressing the cam cylinder in the axial direction, whereby the assembling operation is simplified. Furthermore, it is also possible to omit the screw and the connecting structure of the connecting portion which are required for writing instruments of which the casing is separated into a front part and a rear part and in which these parts are connected by screwing, whereby a nose cone portion can be made small in diameter. In addition, by using the stopper, the aperture engageable with the projection of the cam cylinder is not seen from the exterior of the casing, whereby the aesthetic appearance of the writing instrument is improved and the casing can be formed in various shapes and designs and from various materials.

BRIEF DESCRIPTION OF DRAWINGS

The foregoing summary, as well as the following detailed description of a preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings:

FIG. 7(A) is a partial cross-sectional view and FIG. 7(B) is a plane view;

FIG. 9(A) is a partial cross-sectional view, FIG. 9(B) is a plane view, FIG. 9(C) is an enlarged cross-sectional view taken along line 9(C)-9(C) in FIG. 9(B), and FIG. 9(D) is a view showing an engagement projection;

FIG. 14(A) is a plane view, FIG. 14(B) is a partial cross-sectional view, FIG. 14(C) is an enlarged cross-sectional view taken along line 14(C)-14(C) in FIG. 14(B), and FIG. 14(D) is an enlarged cross-sectional view taken along line 14(D)-14(D) in FIG. 14(B);

FIG. 16(A) and FIG. 16(B) illustrate the state before and after the connection, respectively.

DETAILED DESCRIPTION OF THE PREFERRED EMBODIMENTS

While this invention is susceptible of embodiments in many different forms, this specification and the accompanying drawings disclose only examples of the use of the invention. The invention is not intended to be limited to the embodiments so described, and the scope of the invention will be pointed out in the appended claims.

Figure 1:
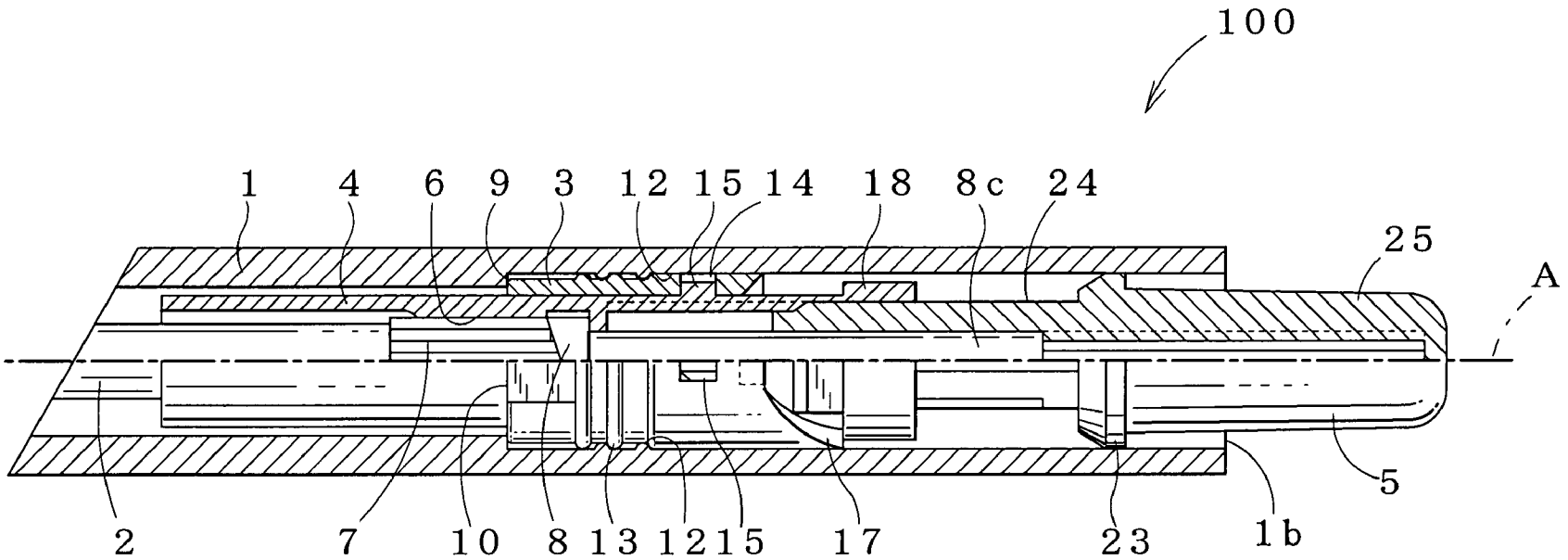
FIG. 1 is a partial cross-sectional view showing a first embodiment of a writing instrument according to the present invention.
Figure 2:
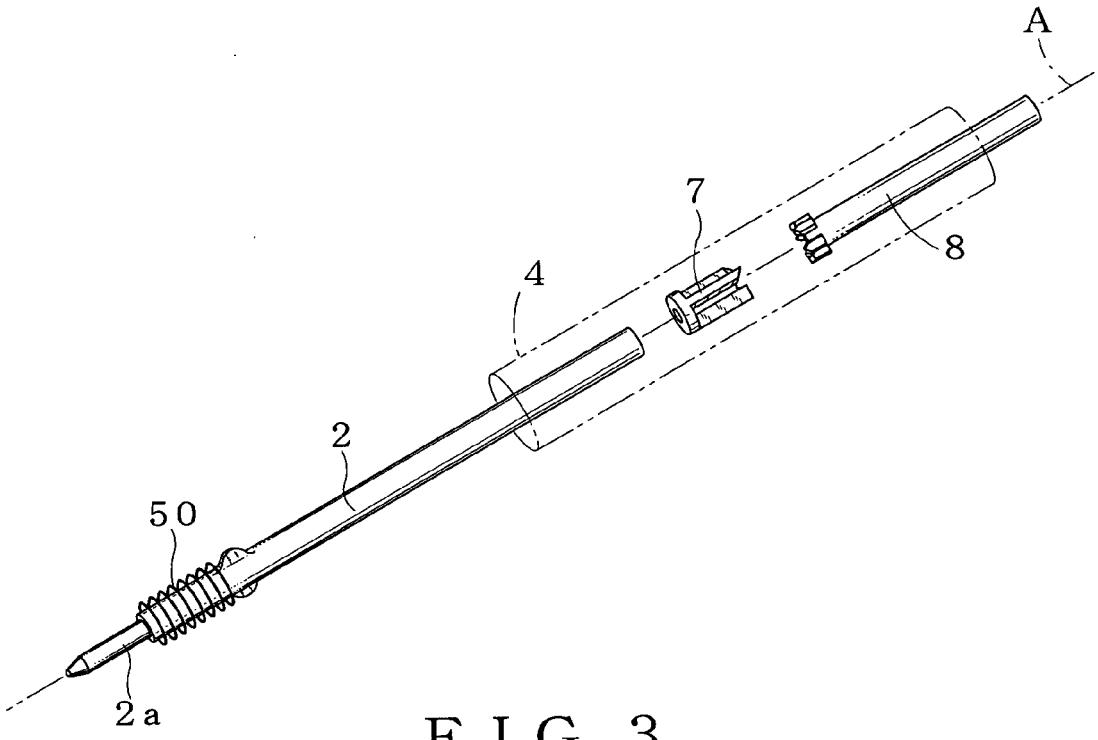
FIG. 2 is a partial exploded view of the writing instrument according to the first embodiment with the cam cylinder shown in phantom.

FIGS. 1-9D show an embodiment of the writing instrument, generally designated at 100, according to the present invention. As shown in FIGS. 1-2, the writing instrument 100 has a barrel 1 in the form of a tubular member or casing having a through-hole extending longitudinally therethrough along a longitudinal axis A. A writing refill 2, such as a ballpoint pen refill, is accommodated in the through-hole of the barrel 1 in the direction of the longitudinal axis A ("longitudinal direction"). Disposed in a rear portion of the barrel 1 are a tubular stopper 3 integrally connected to the barrel 1, a tubular cam cylinder 4 extending through the stopper 3, and a knocking member or element 5 connected to the cam cylinder 4 so as to allow relative linear movement between the cam cylinder 4 and the knocking element 5 in the longitudinal direction while preventing relative rotation between the cam cylinder 4 and the knocking element 5.

Figure 3:
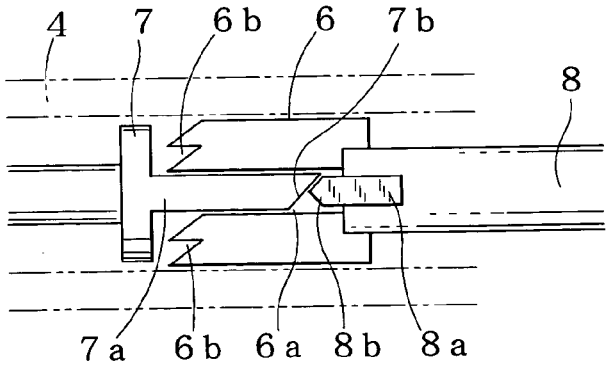
FIG. 3 is a partial cross-sectional view showing the rotary cam mechanism of the writing instrument shown in FIG. 1 with the cam cylinder shown in phantom.
Figure 4:
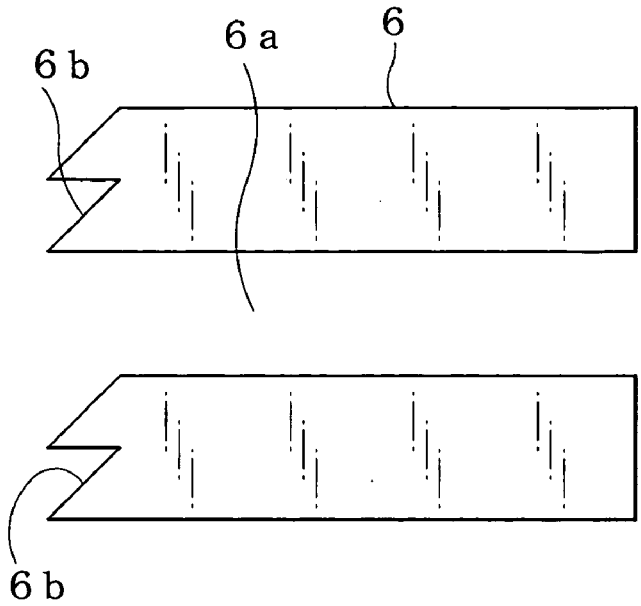
FIG. 4 shows is a front view of the stationary cam of the writing instrument shown in FIG. 1.
Figure 5:
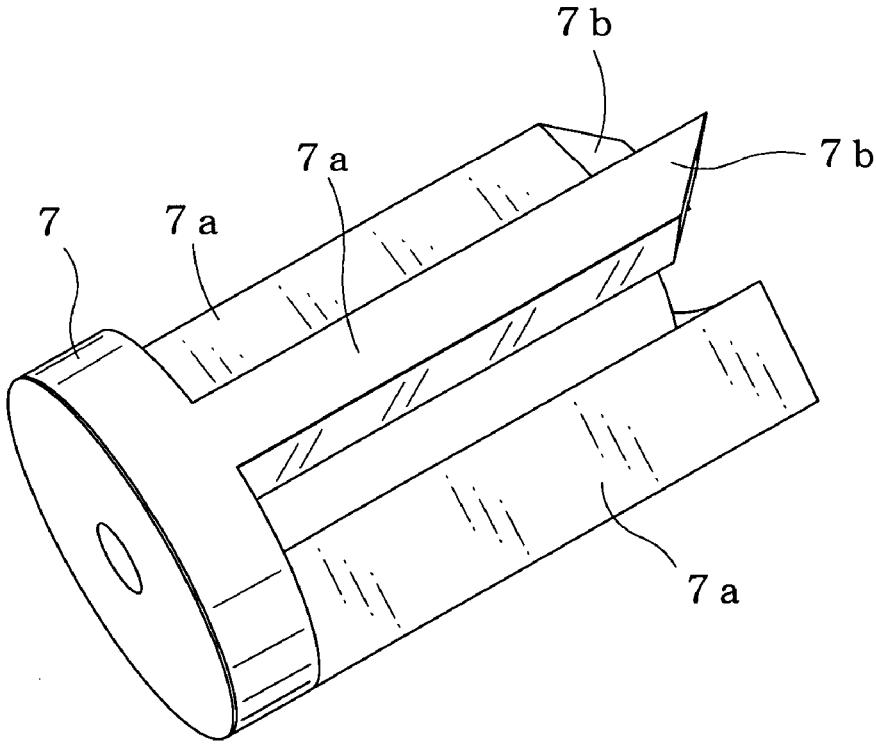
FIG. 5 is a perspective view of the rotary cam of the writing instrument shown in FIG. 1.
Figure 6:
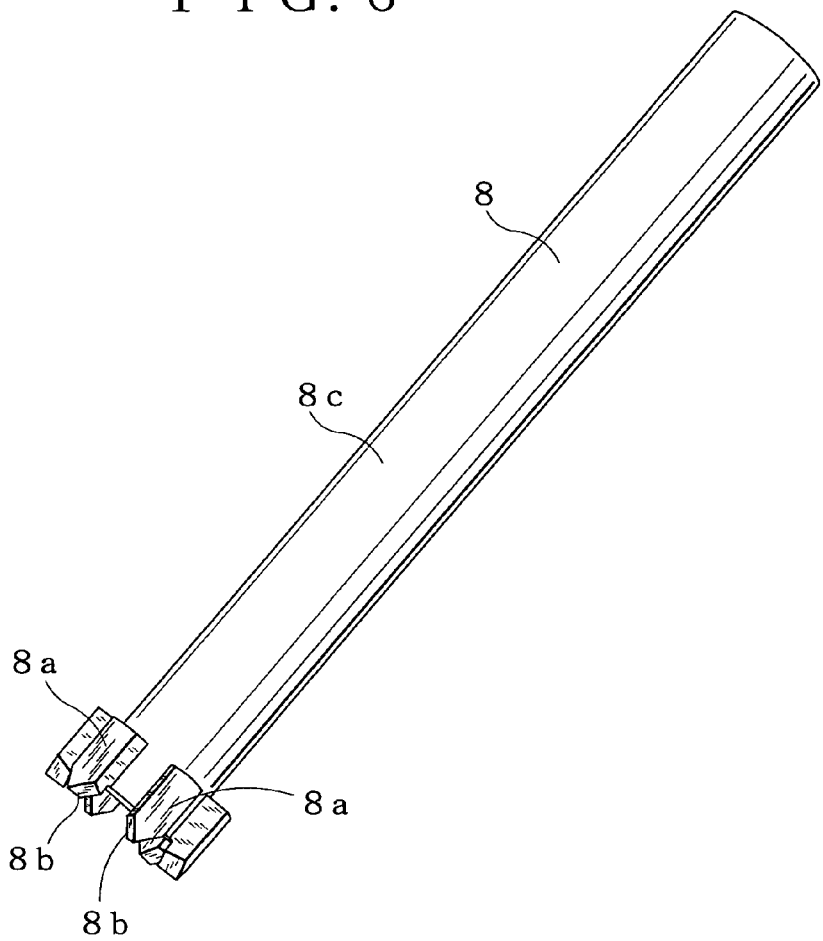
FIG. 6 is a perspective view of the knocking cam of the writing instrument shown in FIG. 1.

The writing instrument 100 has a rotary cam mechanism for feeding or moving the writing refill 2 in the longitudinal direction between a first position, in which a writing tip 2*a* of the writing refill 2 is accommodated in the barrel 1 (retracted position), and a second position, in which the writing tip 2*a* of the writing refill 2 protrudes from the front end of the barrel 1 (writing position). With reference to FIG. 3, the rotary cam mechanism comprises a stationary cam 6 formed in an inner surface of the cam cylinder 4, a rotary cam 7 disposed in the cam cylinder 4, and a knocking cam 8 extending into the cam cylinder 4. As show in FIGS. 3-4, the stationary cam 6 has a guide groove 6*a* extending in the longitudinal direction and a slant cam face 6*b*. As show in FIGS. 3 and 5, the rotary cam 7 has a guide projection 7*a* that enters the guide groove 6*a* of the stationary cam 6 and a rotary cam face 7*b* for engagement with the slant cam face 6*b* of the stationary cam 6. As shown in FIGS. 3 and 6, the knocking cam 8 has a guide projection 8*a* that enters the guide groove 6*a* of the stationary cam 6, a knocking cam face 8*b* for engagement with the rotary cam face 7*b* of the rotary cam 7, and a rod 8*c* detachably connected to the knocking element 5. The writing refill 2 is urged backward (i.e., toward the rear portion of the barrel 1) by a spring 50 and a rear end of the writing refill 2 abuts on the rotary cam 7 (FIG. 2). Accordingly, the rotary cam 7 and the knocking cam 8 are also urged backward by the spring 50 as well.

By the foregoing construction, while the writing tip 2*a* of the writing refill 2 is in the retracted position, the knocking element 5 can be knocked to advance the writing tip 2*a* of the writing refill 2 in the longitudinal direction so as to extend or protrude from the front end of the barrel 1 to place the writing tip 2*a* in the writing position. Likewise, while the writing tip 2*a* of the writing refill 2 is in the writing position, the knocking element 5 can be knocked to retract the writing refill 2 in the longitudinal direction and position the writing tip 2*a* in the barrel 1 in the retracted position.

Figure 7A:
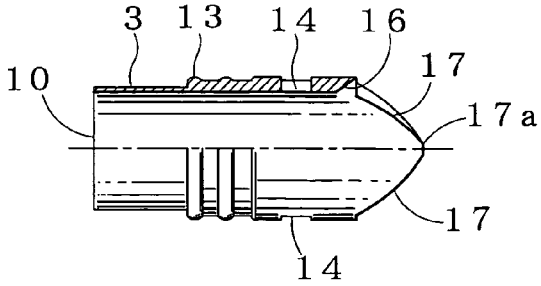
FIGS. 7(A)-7(B) show a stopper of the writing instrument shown in FIG. 1, where
Figure 7B:
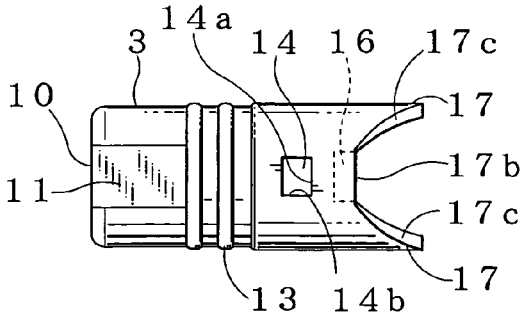

Referring now to FIGS. 1, 7(A)-7(B) and 8, the stopper 3 is formed in a substantially cylindrical shape and has a front end 10 abutting on an inner stepped portion 9 formed in the barrel 1. A rotation-preventing portion 11 of the stopper 3 engages with a rotation-preventing member 1*a* formed in the barrel 1 so as to prevent relative rotation between the stopper 3 and the barrel 1 about the longitudinal axis A. An engagement portion 13 is formed on an outer wall surface of the stopper 3 for engagement with an inner engagement portion 12 formed in the inner surface of the barrel 1. As best shown in FIG. 7(B), a pair of apertures or holes 14 are formed in the outer wall surface of the stopper 3 and are spaced approximately 180 degrees from one another around the circumference of the outer wall surface. A rear portion of the stopper 3 is provided with an inner slant surface 16 formed in the axial direction of the holes 14 for guiding the respective projections 15 of the cam cylinder 4 to engage the holes 14 as further described below. A guide edge 17 of the stopper 3 has rear edge portions terminating in hill-shaped protruding parts 17*a*. The inner slant surface 16 forms a valley part 17*b* at the rear portion of the stopper 3. The valley part 17*b* and the protruding parts 17*a* are connected together by arcuate curved surfaces 17*c*.

Figure 8:
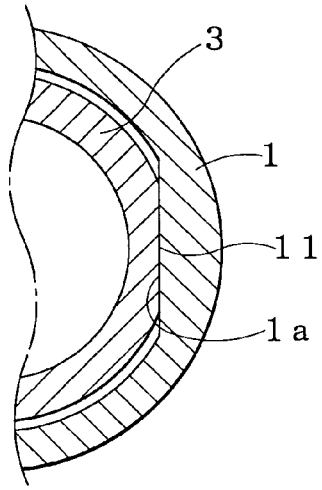
FIG. 8 is a partial cross-sectional view showing an example of the structure of the stopper and the barrel for preventing relative rotation between the stopper and the barrel.

In the embodiment shown in FIG. 8, the rotation-preventing portion 11 of the stopper 3 and the rotation-preventing member 1*a* formed in the barrel 1 are shown in the form of plane surfaces disposed in contact with one another to prevent relative rotation between the stopper 3 and the barrel 1. However, it is understood by those skilled in the art that other forms of rotation preventing means, such as surfaces provided with engaging rib portions, may be employed for preventing relative rotation between the stopper 3 and the barrel 1.

Referring now to FIGS. 9(A)-9(D), the cam cylinder 4 has an inner wall surface 4*a* and an outer wall surface 4*b*. The stationary cam 6 is formed on the inner wall surface 4*a* and the projections 15 project from the outer wall surface 4*b*. The projections 15 are spaced approximately 180 degrees from one another around the circumference of the outer wall surface 4*b* of the cam cylinder 4. A flange 18 is formed at a rear portion and extends from the outer wall surface 4*b* of the cam cylinder 4. A window hole or aperture 19 is formed in the outer wall surface 4*b* of the cam cylinder 4 and extends in a radial direction at a position between the projections 15. A guide groove 20 contiguous with the aperture 19 is formed in an inner surface of the flange 18 and opens toward the rear portion of the cam cylinder 4. The guide groove 20 has a width smaller than that of the aperture 19. The aperture 19 constitutes means for allowing the projections 15 to undergo elastic movement in the radial direction during rotation of the cam cylinder 4 to facilitate engagement between the projections 15 and the respective holes 14 of the stopper 3.

Figure 9A:
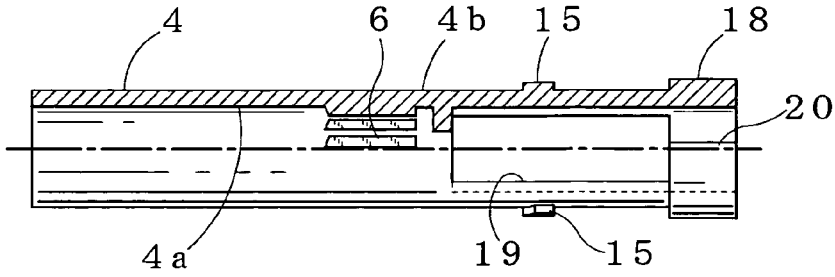
FIGS. 9(A)-9(D) show a cam cylinder of the writing instrument shown in FIG. 1, where
Figure 9B:
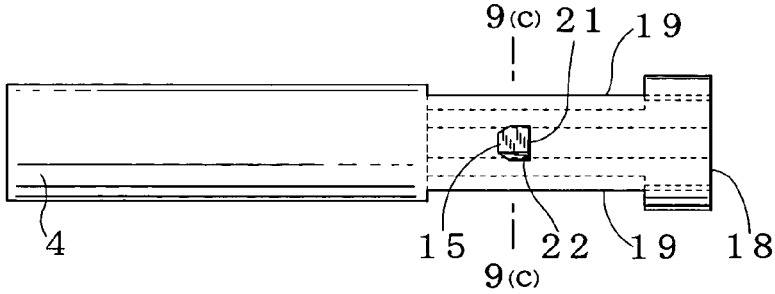
Figure 9C:
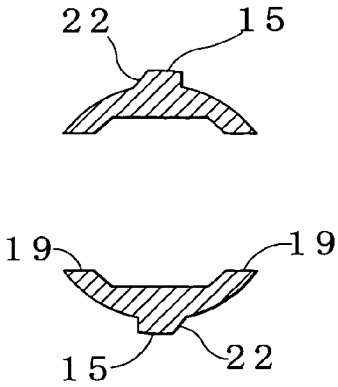
Figure 9D:
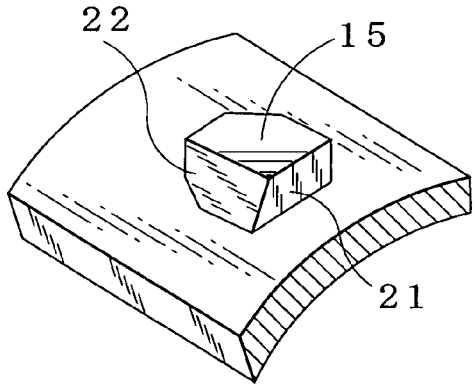

As shown in FIGS. 9(B)-9(D), each of the projections 15 has a vertical edge surface 21 and a slant or inclined edge surface 22. The vertical edge surface 21 (i.e., the surface 21 is generally perpendicular to the longitudinal axis A) is configured for engagement with an edge 14*a* (FIG. 7(B)) of the corresponding stopper hole 14 and extends in an axial direction of the corresponding stopper hole 14. By this construction, the projections 15 can be securely engaged with the vertical edge surface 21 of the respective holes 14 while preventing the projections 15 from slipping off in the axial direction. Stated otherwise, when engaged with the holes 14, the projections 15 are prevented from detaching in the axial direction (i.e., in the direction of the longitudinal axis A). The inclined edge surface 22 (i.e., the surface 22 is not generally perpendicular to the longitudinal axis A) of each projection 15 is configured for detachable engagement with an edge 14*b* (FIG. 7(B)) of the corresponding stopper hole 14 and extends in a radial or circumferential direction of the corresponding stopper hole 14. By this construction, when the cam cylinder 4 is rotated, the projections 15 will slip off the respective stopper holes 14 and readily enter the inner surface of the stopper 3.

Figure 10:
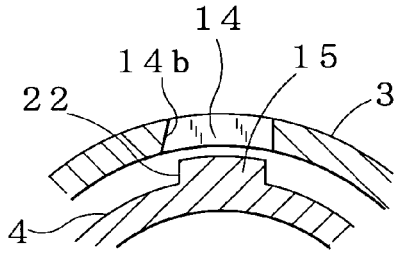
FIG. 10 is a partial cross-sectional view showing a modified version of the hole edge of the stopper and the edge face of the projection of the cam cylinder.
Figure 11:
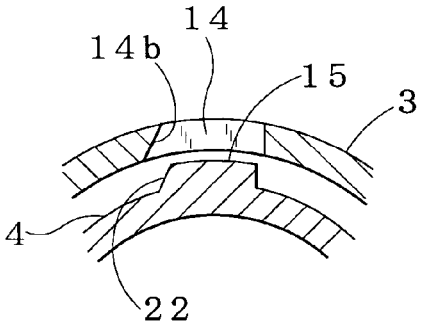
FIG. 11 is a partial cross-sectional view showing another modified version of the hole edge of the stopper and the edge face of the projection of the cam cylinder.
Figure 12:
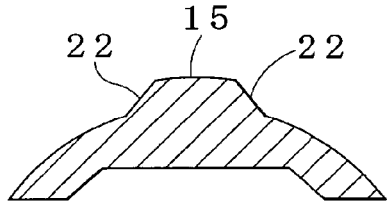
FIG. 12 is a plane view showing another modified version of the cam cylinder shown in FIGS. 9(A)-9(D)

In the embodiment shown in FIGS. 9(A)-9(D), the projections 15 of the cam cylinder 4 are provided with the inclined edge surface 22. Alternatively, as shown in FIG. 10, the edge 14*b* of the stopper holes 14 may be in the form of an inclined edge surface and the edge surface 22 of the cam cylinder 4 may be in the form of a vertical edge surface. In another embodiment, as shown in FIG. 11, both the edge 14*b* of the stopper holes 14 and the edge surface 22 of the cam cylinder 4 may be formed as conforming inclined edge surfaces. In yet another embodiment, as shown in FIG. 12, inclined edge surfaces 22 may be formed on both side surfaces of the projections 15 rather than on only one side surface as shown in FIG. 11. By these alternative forms of construction, the projections 15 detachably engage with the respective stopper holes 14 when the cam cylinder 4 is rotated. In this case, the aperture 19 of the cam cylinder 4 permits the projections 15 to undergo elastic movement in the radial direction during rotation of the cam cylinder 4 so that the projections 15 can readily engage the respective holes 14 of the stopper 3.

Figure 13:
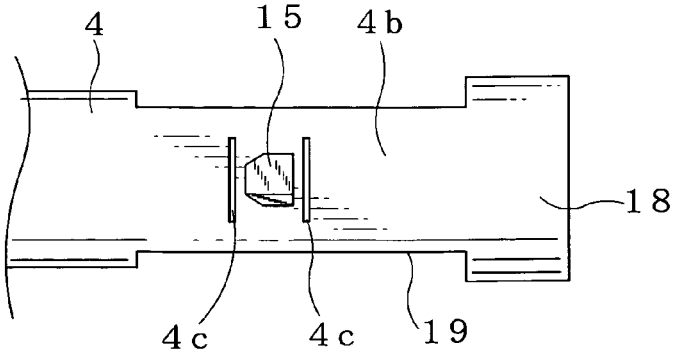
FIG. 13 showing another modified version of the cam cylinder shown in FIGS. 9(A)-9(D)

FIG. 13 shows a modified form of the cam cylinder 4. In FIG. 13, for each projection 15 of the cam cylinder 4, a pair of slits 4*c* are formed in the outer wall surface 4*b* of the cam cylinder in directions generally perpendicular to the longitudinal axis A so that the projection 15 is disposed between the slits 4*c*. The slits 4*c* further facilitate elastic movement of the projections 15 in the axial direction during rotation of the cam cylinder 4. It is understood that elastic movement of the projections 15 in the axial direction during rotation of the cam cylinder 4 may be facilitated by means other than the slits 4*c*, such as by making the outer wall of the cam cylinder 4 thin. Accordingly, it will be appreciated that elastic movement of the projections 15 in the axial direction during rotation of the cam cylinder 4 may be facilitated by structural means other than those described above without departing from the spirit and scope of the invention.

Figure 14A:
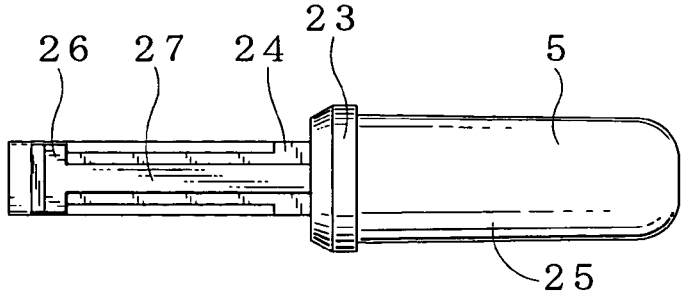
FIGS. 14(A)-14(D) show a knocking element of the writing instrument shown in FIG. 1, where
Figure 14B:
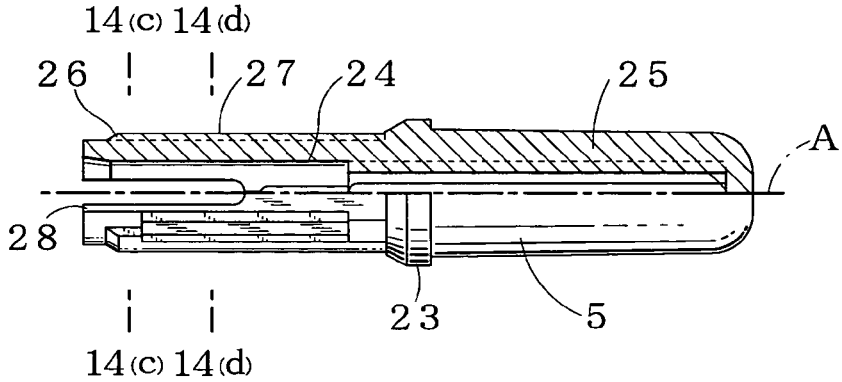
Figure 14C:
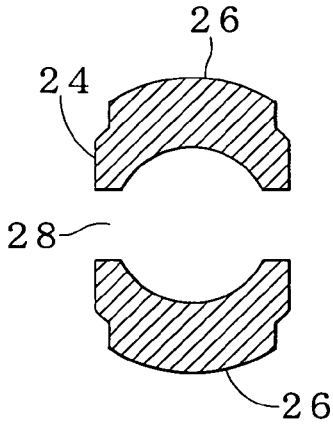

Referring now to FIGS. 14(A)-14(C), the knocking element 5 has a flange 23 and a tubular connecting portion 24 integral with and extending from one side of the flange 23. The connecting portion 24 is configured to be inserted into the cam cylinder 4 and has a substantially rectangular cross-sectional shape with generally planar or flat side surfaces for engagement with the inner wall surface 4*a* of the cam cylinder 4 to prevent relative rotation between the cam cylinder 4 and the knocking element 5. A knocking head 25 is integral with and extends from an opposite side of the flange 23 so that the knocking head 25 protrudes exteriorly from the rear end portion of the barrel 1. The connecting portion 24 has connecting projections 26 and rib portions 27 integral with the connecting projections 26.

Figure 14D:
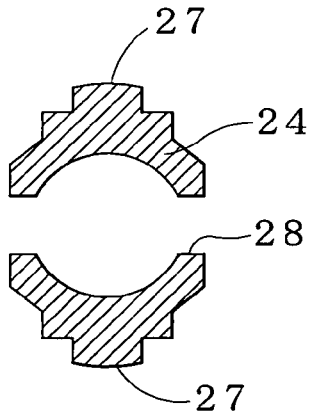

As shown in FIG. 14(C), each of the connecting projections 26 extends in the circumferential direction of the knocking element 5 so that they slidably fit into the aperture 19 of the cam cylinder 4. As shown in FIGS. 14(A) and 14(D), each of the rib portions 27 extend in the direction of the longitudinal axis A and are inserted in the guide groove 20 of the cam cylinder 4. The rib portions 27 of the knocking element 5 and the guide groove 20 of the cam cylinder 4 constitute means for guiding the relative sliding movement between the cam cylinder 4 and the knocking element 5 in the longitudinal direction. An axial slit 28 is formed in the connecting portion 24 to facilitate insertion of the connecting portion 24 into the cam cylinder 4. As shown in FIG. 1, the rod 8*c* of the knocking cam 8 is inserted into the connecting portion 24 of the knocking element 5 in the assembled state of the writing instrument 100.

Figure 15:
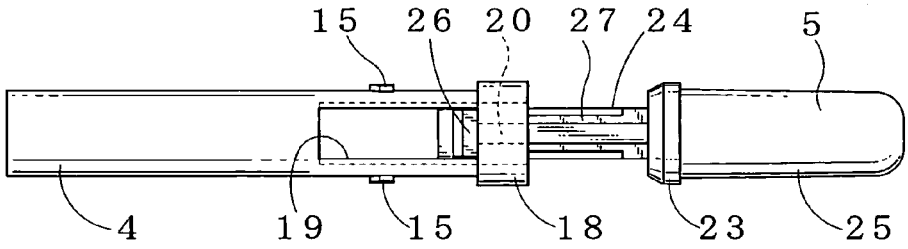
FIG. 15 is a view illustrating the state in which the cam cylinder and the knocking element of the writing instrument shown in FIG. 1 are connected together.
Figure 16A:
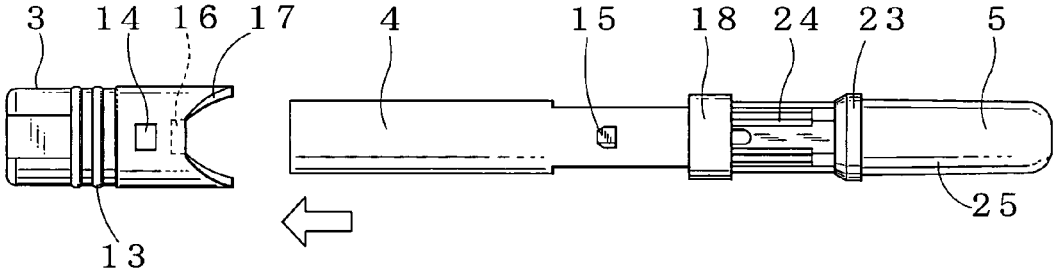
FIGS. 16(A)-16(B) show the state in which the stopper is connected to the connected cam cylinder and knocking element shown in FIG. 15, where
Figure 16B:
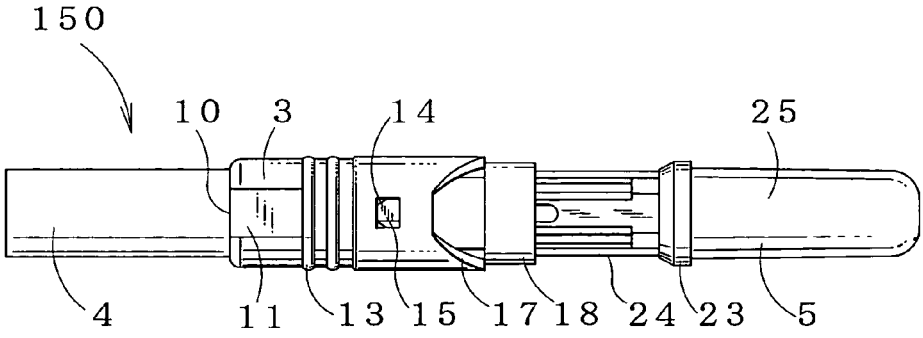

FIGS. 15 and 16(A)-16(B) show states for connecting the stopper 3, cam cylinder 4 and knocking element 5 together into an integral unit prior to assembling the integral unit into the barrel 1. As shown in FIG. 15, the connecting portion 24 of the knocking element 5 is inserted into the cam cylinder 4 by inserting the rib portions 27 in the guide groove 20 of the cam cylinder 4. In this state, relative rotation between the cam cylinder 4 and the knocking element 5 is prevented while the knocking element 5 is permitted to slide in the longitudinal direction relative to the cam cylinder 4. Thereafter, as shown in FIG. 16(A), the cam cylinder 4 is inserted into the stopper 3 until the projections 15 of the cam cylinder 4 engage the respective holes 14 of the stopper 3. At this point, a front end portion of the cam cylinder 4 projects from a front end 10 of the stopper 3. FIG. 16(B) shows the assembled state of the stopper 3, cam cylinder 4 and knocking element 5 into the integral unit 150.

Prior to connecting the integral unit 150 to the barrel 1, the rotary cam 7 and the knocking cam 8 are assembled relative to the stopper 3, the cam cylinder 4, and the knocking element 5. More specifically, the rod 8*c* of the knocking cam 8 is inserted into the cam cylinder 4 and into the connecting portion 24 of the knocking element 5 and connected thereto by friction fit. The rotary cam 7 is then inserted into the cam cylinder 4 and the rotary cam face 7*b* of the rotary cam 7 is engaged with the knocking cam face 8*b* of the knocking cam 8.

Thereafter, in the state in which the rotary cam 7 and the knocking cam 8 have been assembled relative to the integral unit 150 and the writing refill 2 has been preliminarily inserted in the barrel 1, the front end portion of the cam cylinder 4 is inserted into a rear end 1*b* of the barrel 1 until the front end 10 of the stopper 3 abuts on the inner stepped portion 9 of the barrel 1. At this point, the engagement portion 13 of the stopper 3 engages with the inner engagement portion 12 of the barrel 1 and, at the same time, the rotation-preventing portion 11 of the stopper 3 is locked with the rotation-stopping member 1*a* of the barrel 1, whereby the stopper 3 and the barrel 1 are connected together in a non-rotatable state. Furthermore, the guide projection 7*a* of the rotary cam 7 and the guide projection 8*a* of the knocking cam 8 enter the guide groove 6*a* of the stationary cam 6 in the barrel 1, and the rear end of the writing refill 2 abuts on the front end of the rotary cam 7. In this assembled state of the writing instrument 100, the writing refill 2 can be advanced and retracted in the longitudinal direction by knocking the knocking element 5 to position the writing tip 2*a* of the writing refill between the writing position and the retracted position.

Since the knocking element 5 is connected in a non-rotation state relative to the cam cylinder 4, replacement of the writing refill 2 can be accomplished by rotating the knocking element 5. Upon rotation of the knocking element 5, the projections 15 of the cam cylinder 4 are detached from the respective holes 14 of the stopper 3. At this point, by pulling the knocking element 5 rearwardly in the longitudinal direction (i.e., by pulling the cam cylinder 4 to the right in FIG. 1), the cam cylinder 4 can be separated from the stopper 3. Thereafter, by pulling the cam cylinder 4 and the knocking element 5 (still in a connected state) out of the rear end 1*b* of the barrel 1, the writing refill 2 can be taken out from the rear end 1*b* of the barrel 1. After a new writing refill 2 is inserted into the barrel, the connected cam cylinder 4 and knocking element 5 are inserted into the barrel 1 from the rear end 1*b* thereof and the cam cylinder 4 is engaged with the stopper 3 as described above to place the writing instrument in the assembled state for a writing operation.

Figure 17:
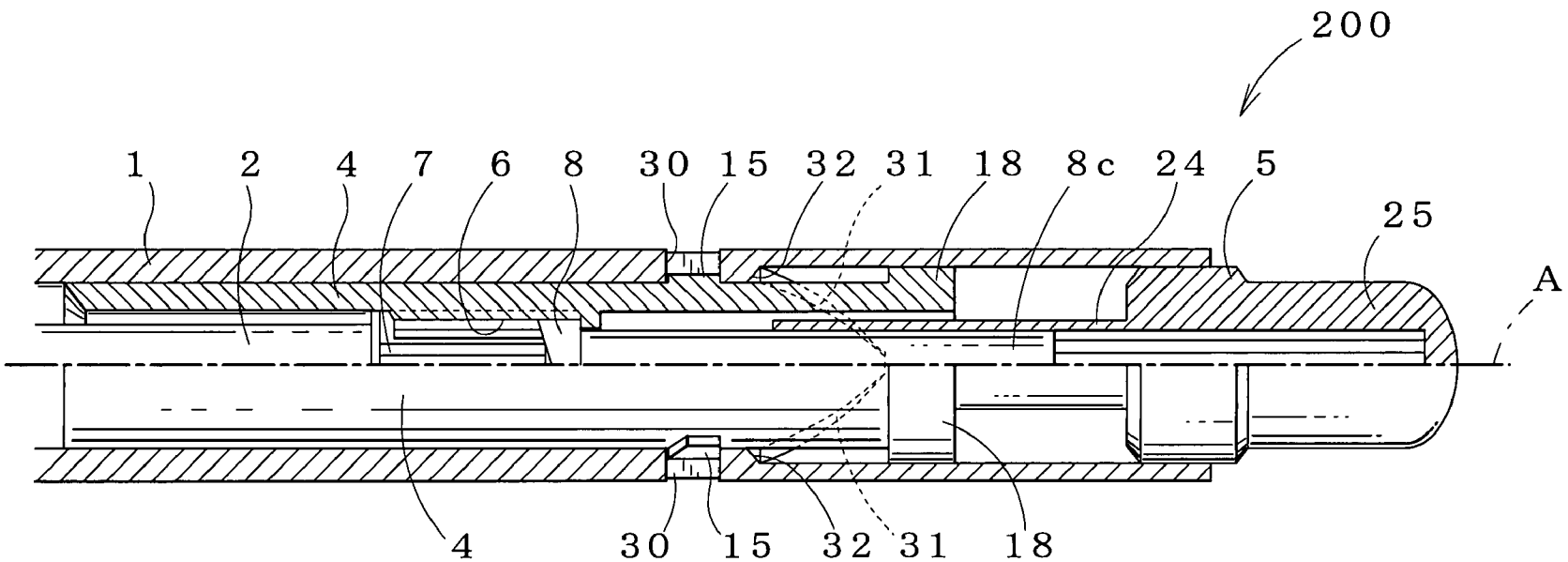
FIG. 17 is a partial cross-sectional view showing another embodiment of the writing instrument according to the present invention.

FIG. 17 shows another embodiment of a writing instrument 200 according to the present invention. The structure and function of the writing instrument 200, including the barrel 1, cam cylinder 4 and knocking element 5, are generally the same as described above for the writing instrument 100, except as further described below. For ease of understanding, the same numerals used with reference to the writing instrument 100 will be used to describe the corresponding components of the writing instrument 200.

The writing instrument 200 does not have a stopper as described above for the writing instrument 100. In the writing instrument 200, a pair of apertures or holes 30 are formed in an outer side wall surface of the barrel 1 and are spaced approximately 180 degrees from one another around the circumference of the outer side wall surface. The projections 15 of the cam cylinder 4 are prevented from detaching in the axial direction (i.e., in the direction of the longitudinal axis A) by detachable engagement with the respective holes 30 of the barrel 1. The side surface of the projection 15 is formed as an inclined edge surface 22 as shown in FIG. 9(D). A guide edge 31 and an inner inclined edge 32 are formed in the inner surface of the barrel 1 for guiding the projections 15 of the cam cylinder 4 to the respective holes 30 when the cam cylinder 4 is inserted into the barrel from the rear end 1*b* of the barrel 1.

By this construction, the writing instrument 200 can simply be assembled by inserting the cam cylinder 4 in the barrel 1 from the rear end 1*b* of the barrel 1. Furthermore, by rotating the cam cylinder 4, the projections 15 can be disengaged from the holes 30 of the barrel 1 and the cam cylinder 4 can be taken out of the barrel 1 to replace the writing refill as described above for the writing instrument 100. The writing instrument 200 has a simpler structure and is more economical to manufacture than the writing instrument 100 because it does not require the use of the stopper.

The writing instrument according to the present invention has a simpler construction and is more economical to manufacture as compared to conventional writing instruments, such as disclosed in U.S. Pat. Nos. 5,413,428, 5,263,786 and 5,004,364. The writing instrument of the present invention provides a rotary cam mechanism which is capable of efficiently positioning a writing refill between a writing position and a retracted position while permitting the writing refill to be replaced by rotating a knocking part of the rotary cam mechanism. Furthermore, the writing refill can be replaced from the rear end side of a barrel by removing parts of the rotary cam mechanism without detaching a nose cone or disassembling the barrel of the writing instrument. Thus, the present invention obviates the need for barrels having screwed portions which must be disengaged in order to replace a writing refill, thereby removing restrictions in the aesthetic appearance of the writing instrument, such as the provision of a transparent barrel.

From the foregoing description, it can be seen that the present invention comprises an improved writing instrument. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

We claim:

1. A writing instrument comprising:

a tubular casing having a through-hole extending in a longitudinal direction of the casing, a wall surface, and two apertures formed in the wall surface;

a writing refill inserted in the through-hole of the tubular casing for extension out of the casing to a writing position and retraction into the casing to a retracted position;

a rotary cam mechanism accommodated in the through-hole of the casing for extending and retracting the writing refill between the writing position and the retracted position, respectively, the rotary cam mechanism comprising a cam cylinder inserted into the through-hole of the casing from a rear end thereof and having a stationary cam and two projections that have vertical edge surfaces on rear ends thereof engageable with respective ones of the two apertures of the casing to prevent movement of the cam cylinder relative to the casing in the longitudinal direction and disengageable from the apertures in response to rotational movement of the cam cylinder relative to the casing in a direction of rotation to permit withdrawal of the cam cylinder from the rear end of the casing, a rotary cam engageable with the stationary cam of the cam cylinder, and a knocking cam engageable with the stationary cam of the cam cylinder and the rotary cam; and a knocking member integrally connected to the knocking cam and connected to the cam cylinder in a non-rotatable state while permitting movement of the knocking member relative to the cam cylinder in the longitudinal direction.

2. A writing instrument according to claim 1; wherein the stationary cam has a guide groove and a slant cam surface; and wherein the rotary cam has a guide projection inserted in the guide groove of the stationary cam and a rotary cam surface engageable with the slant cam surface of the stationary cam.

3. A writing instrument according to claim 2; wherein the knocking cam has a guide projection inserted in the guide groove of the stationary cam and a knocking cam surface engageable with the rotary cam surface of the rotary cam.

4. A writing instrument according to claim 1; wherein the cam cylinder has a tubular construction; and wherein the rotary cam and the knocking cam are inserted in the cam cylinder.

5. A writing instrument according to claim 4; wherein the stationary cam is formed in an inner surface of the cam cylinder.

6. A writing instrument according to claim 1; wherein the projections of the cam cylinder have slant side edge surfaces slanting towards the direction of rotation of the cam cylinder.

7. A writing instrument according to claim 1; wherein the apertures formed in the wall surface of the casing each have a slant surface slanting towards the direction of rotation of the cam cylinder.

8. A writing instrument according to claim 1; further comprising means for permitting the projections of the cam cylinder to undergo elastic movement in a radial direction of the cam cylinder during rotation of the cam cylinder in the direction of rotation.

9. A writing instrument according to claim 8; wherein the means for permitting the projections of the cam cylinder to undergo elastic movement comprises an aperture formed in the cam cylinder adjacent to the projections.

10. A writing instrument according to claim 9; wherein the knocking member has a connecting portion engaging the aperture of the cam cylinder and a rib portion inserted in the guide groove of the cam cylinder.

11. A writing instrument according to claim 8; wherein the means for permitting the projections of the cam cylinder to undergo elastic movement comprises a pair of slits formed in the cam cylinder with the projections disposed between the slits.

12. A writing instrument according to claim 1; wherein the apertures of the casing comprise through-holes opening to a side wall of the casing.

13. A writing instrument according to claim 12; further comprising a guide edge formed on an inner wall surface of the casing for guiding the projections of the cam cylinder to the apertures of the casing during insertion of the cam cylinder into the casing.

14. A writing instrument comprising:

a tubular casing having a through-hole extending in a longitudinal direction of the casing;

a writing refill inserted in the through-hole of the tubular casing for extension out of the casing to a writing position and retraction into the casing to a retracted position;

a tubular stopper inserted into and integrally connected to an inner surface of the casing, the stopper having two apertures;

a rotary cam mechanism accommodated in the through-hole of the casing for extending and retracting the writing refill between the writing position and the retracted position, respectively, the rotary cam mechanism comprising a cam cylinder inserted into the stopper from a rear end thereof and having a stationary cam and two projections that have vertical edge surfaces on rear ends thereof engageable with respective ones of the two apertures of the stopper, a rotary cam engageable with the stationary cam of the cam cylinder, and a knocking cam engageable with the stationary cam of the cam cylinder and the rotary cam; and a knocking member integrally connected to the knocking cam and connected to the cam cylinder in a non-rotatable state while permitting movement of the knocking member relative to the cam cylinder in the longitudinal direction.

15. A writing instrument according to claim 14; wherein the stopper has a guide edge formed at a rear end portion of the stopper for guiding the proiections of the cam cylinder to the apertures of the stopper during insertion of the cam cylinder into the stopper.

16. A writing instrument according to claim 14; wherein the stationary cam has a guide groove and a slant cam surface; and wherein the rotary cam has a guide projection inserted in the guide groove of the stationary cam and a rotary cam surface engageable with the slant cam surface of the stationary cam.

17. A writing instrument according to claim 16; wherein the knocking cam has a guide projection inserted in the guide groove of the stationary cam and a knocking cam surface engageable with the rotary cam surface of the rotary cam.

18. A writing instrument according to claim 14; wherein the cam cylinder has a tubular construction; and wherein the rotary cam and the knocking cam are inserted in the cam cylinder.

19. A writing instrument according to claim 18; wherein the stationary cam is formed in an inner surface of the cam cylinder.

20. A writing instrument according to claim 14; wherein the projections of the cam cylinder have slant side edge surfaces slanting towards the direction of rotation of the cam cylinder.

21. A writing instrument according to claim 14; wherein the stopper apertures each have a slant surface slanting towards the direction of rotation of the cam cylinder.

22. A writing instrument according to claim 14; further comprising means for permitting the projections of the cam cylinder to undergo elastic movement in a radial direction of the cam cylinder during rotation of the cam cylinder in the direction of rotation.

23. A writing instrument according to claim 22; wherein the means for permitting the projections of the cam cylinder to undergo elastic movement comprises an aperture formed in the cam cylinder adjacent to the projections.

24. A writing instrument according to claim 23; wherein the knocking member has a connecting portion engaging the aperture of the cam cylinder and a rib portion inserted in the guide groove of the cam cylinder.

25. A writing instrument according to claim 22; wherein the means for permitting the projections of the cam cylinder to undergo elastic movement comprises a pair of slits formed in the cam cylinder with the projections disposed between the slits.

26. A writing instrument comprising: a tubular casing having a front end and a rear end axially spaced from the front end; a writing refill inserted into the casing from the rear end thereof; means defining apertures that are fixed in place relative to the casing; a rotary cam mechanism for extending and retracting the writing refill, the rotary cam mechanism including a cam cylinder that is inserted axially into the casing from the rear end thereof and that has a stationary cam and projections which have vertical rear edge surfaces engageable with respective ones of the apertures to prevent axial movement of the cam cylinder relative to the casing and disengageable from the apertures in response to rotational movement of the cam cylinder relative to the casing to permit axial withdrawal of the cam cylinder from the rear end of the casing, a rotary cam engageable with the stationary cam of the cam cylinder, and a knocking cam engageable with the stationary cam of the cam cylinder and the rotary cam; and a knocking member integrally connected to the knocking cam and connected to the cam cylinder to undergo axial movement relative thereto and to undergo rotational movement jointly therewith.

27. A writing instrument according to claim 26; wherein the projections have inclined side edge surfaces that are inclined in a direction of rotational movement of the cam cylinder relative to the casing.

28. A writing instrument according to claim 26; wherein the apertures are formed in the casing and are circumferentially spaced from one another about the casing.

29. A writing instrument according to claim 26; including a tubular stopper inserted into the casing and connected to an inner surface of the casing, the cam cylinder being inserted axially into the stopper and the apertures being formed in the stopper in circumferentially spaced relation from one another about the stopper.

* * * * *